US005176812A

United States Patent [19]

Suda et al.

[11] Patent Number: 5,176,812

[45] Date of Patent: Jan. 5, 1993

[54] COPPER FIN MATERIAL FOR HEAT-EXCHANGER AND METHOD OF PRODUCING THE SAME

[75] Inventors: Hideo Suda, Imaichi; Norimasa Sato, Utsunomiya; Katsuhiko Takada; Sumio Susa, both of Anjo; Yasushi Aiyoshizawa, Nikko; Kenichi Omata, Imaichi, all of Japan

[73] Assignees: The Furukawa Electric Co., Ltd., Tokyo; Nippondenso Co., Ltd., Kariya, both of Japan

[21] Appl. No.: 737,430

[22] Filed: Jul. 29, 1991

Related U.S. Application Data

[62] Division of Ser. No. 454,460, Dec. 21, 1989, Pat. No. 5,063,117.

[30] Foreign Application Priority Data

| | | | |
|---|---|---|---|
| Dec. 27, 1988 | [JP] | Japan | 63-327697 |
| Jan. 30, 1989 | [JP] | Japan | 1-20275 |
| Mar. 1, 1989 | [JP] | Japan | 1-49177 |
| Mar. 1, 1989 | [JP] | Japan | 1-49178 |

[51] Int. Cl.[5] ..... C25D 5/50

[52] U.S. Cl. ..... 205/228; 205/244; 205/245; 427/436; 165/134.1; 148/536

[58] Field of Search ..... 204/37.1, 34.2; 428/610; 205/228, 244, 245; 427/383.9, 436; 165/134.1

[56] References Cited

U.S. PATENT DOCUMENTS 4,892,141 1/1990 Shiga et al. ..... 428/610

FOREIGN PATENT DOCUMENTS 172690 8/1986 Japan .
127096 5/1988 Japan .
68459 3/1989 Japan .

*Primary Examiner*—John Niebling
*Assistant Examiner*—Kishor Mayekar
*Attorney, Agent, or Firm*—Oblon, Spivak, McClelland, Maier & Neustadt

[57] ABSTRACT

A copper fin material for heat-exchangers is characterized in that, on the surface of Cu or Cu alloy strip, an inner side diffused layer comprising Cu and Zn and a surface side diffused layer provided on the surface side thereof comprising Cu, Zn and elements with a lower diffusion coefficient into Cu than that of Zn is formed. A method of producing the same is characterized in that, after an alloy film comprising Zn and element with a lower diffusion coefficient into Cu than that of Zn is formed on the surface of a Cu or Cu alloy strip, a diffusion treatment is performed under heat so that, on the surface of the Cu or Cu alloy strip, an inner side diffused layer comprising Cu and Zn and a surface side diffused layer provided on the surface side thereof comprising Cu, Zn and elements with a lower diffusion coefficient into Cu than that of Zn are formed. Alternatively, the diffusion treatment under heat is combined with a rolling processing step.

8 Claims, 2 Drawing Sheets

COPPER FIN MATERIAL FOR HEAT-EXCHANGER AND METHOD OF PRODUCING THE SAME

This is a division of application Ser. No. 07/454,460, filed on Dec. 21, 1989, now U.S. Pat. No. 5,063,117.

BACKGROUND OF THE INVENTION

The present invention relates to a copper fin material for a heat-exchanger, suitable for use under the severe conditions and corrosive environment of automobile engines, etc. The present invention also relates to a method of producing the same. In particular, the present invention has made it possible to improve the corrosion resistance of a copper fin material and to thin the fin without decreasing its thermal conductivity.

Recently, a trend in the lightening in weight of automobile radiators has been associated with thinning the fin material for heat-exchangers. On the other hand, the corrosion due to the salt damage caused by snow-melting material etc. has become a problem. The severe corrosion of fin material due to salt damage seriously affects the heat-exchanger, such as decreasing the radiating characteristics, deteriorating the strength and the like.

In general, improvements in the strength, corrosion resistance, etc. are all desired for the heat-exchanger fin material. With respect to the improvement in corrosion resistance, the improvement is possible by alloying the material through the addition of second and third elements such as, for example, Cu-Ni type anticorrosive alloys. This brings about, however, not only an increase in cost resulting in an economical disadvantage, but also a drastic decrease in thermal conductivity (electroconductivity). Hence, even if the fin material exhibits excellent corrosion resistance, it ends up becoming quite unsuitable as a heat-exchanger fin material, high electroconductivity being desired therefor.

On the other hand, corrosion is principally a phenomenon on the surface. Thus, if only the surface of the material is modified, it should be possible to substantially maintain the electroconductivity, and yet, improve the corrosion resistance. Based on this thought, a fin material suitable for a car radiator has been proposed, wherein the fin material has a diffused layer of Zn formed on the surface of a highly electroconductive copper-based material. Thus, the inside core material is protected by a sacrificial anode effect, yet the electroconductivity of the core material is retained. In fact, a distinct effect on the improvement in the corrosion resistance can be seen by forming the diffused layer of Zn on the surface. However, because the diffused layer of Zn formed on the surface is restricted in thickness to several μm or so per side, and further that, in this case, the surface becomes a Cu-Zn alloy (so-called brass), the problem arises of Zn disappearing through the dezincificative corrosion inherent to brass. Thus, the sacrificial anode effect of Zn cannot be retained over a long period of time.

As described above, although the diffused layer of Zn formed on the surface is restricted to several μm or so per side in thickness, if the dezincificative corrosion inherent to brass can be suppressed and prevented effectively, a more corrosion resistant fin material for heat-exchangers could be expected, while thinning of the fin material would also become possible.

In order to suppress such dezincificative corrosion inherent to brass, a method is conceivable wherein a third element is added into the diffused layer of Cu-Zn, in order to improve the corrosion resistance. Thus, the Zn-diffused layer would become highly corrosion-resistant.

Various elements can be considered for suppressing the dezincificative corrosion. However, generally, remarkably large decreases in the thermal conductivity occur when adding these elements to copper, compared to the same fin material which adds the same amount of Zn. Hence, if these elements are added to the entire diffused layer in a sufficient amount to suppress and prevent effectively the dezincificative corrosion etc., the corrosion resistance would be improved, but the decrease in the thermal conductivity would end up becoming large.

As a result of extensive investigations in view of this situation, a copper fin material for heat-exchangers, excellent in both corrosion resistance and thermal conductivity, and a method of producing the same have been developed. According to the present invention, the dezincificative corrosion of a Zn-diffused layer formed on the surface of a Cu or Cu alloy strip is alleviated, while the decrease in thermal conductivity arising from the addition of a third element into the Zn-diffused layer is lessened.

SUMMARY OF THE INVENTION

The copper fin material for heat-exchanger of the present invention is characterized in that, on the surface of a Cu or Cu alloy strip, an inner side diffused layer comprising Cu and Zn and a surface side diffused layer provided on the surface side thereof comprising Cu, Zn and elements with a lower diffusion coefficient into Cu than that of Zn are formed.

Moreover, another copper fin material for heat-exchanger of the present invention is characterized in that, on the surface of a heat-resisting copper strip containing one or more elements selected from the group consisting of Mg, Zn, Sn, Cd, Ag, Ni, P, Zr, Cr, Pb and Al in total amounts of 0.01 to 0.13 wt. %, the remainder being Cu, and having an electroconductivity of not lower than 90% IACS, an inner side diffused layer comprising Cu and Zn and a surface side diffused layer provided on the surface side thereof comprising Cu, Zn and elements with a lower diffusion coefficient into Cu than that of Zn are formed.

Furthermore, a method of producing the copper fin material for heat-exchanger of the present invention is characterized in that, after an alloy film comprising Zn and elements with a lower diffusion coefficient into Cu than that of Zn is formed on the surface of a Cu or Cu alloy strip, a heat diffusion treatment is performed so that, on the surface of the Cu or Cu alloy strip, an inner side diffused layer comprising Cu and Zn, and a surface side diffused layer provided on the surface side thereof comprising Cu, Zn and elements with a lower diffusion coefficient into Cu than that of Zn are formed. Alternatively, the heat diffusion treatment is combined with a rolling processing step.

Even further, another method of producing the fin material of the present invention is characterized in that, after an alloy film comprising Zn and elements with a lower diffusion coefficient into Cu than that of Zn formed on the surface of a heat-resisting copper strip containing one or more members selected from the group consisting of Mg, Zn, Sn, Cd, Ag, Ni, P, Zr, Cr, Pb and Al in total amounts of 0.01 to 0.13 wt. %, the remainder being Cu, said heat-resisting copper strip having an electroconductivity of not lower than 90% IACS, a heat diffusion treatment is performed so that, on the surface of said heat-resisting copper strip, an inner side diffused layer comprising Cu and Zn and a surface side diffused layer provided on the surface side thereof comprising Cu, Zn and elements with a lower diffusion coefficient into Cu than that of Zn are formed. Alternatively, the heat diffusion treatment is combined with a rolling processing step.

Furthermore, in either case above, it is desirable to use at least one member of the group consisting of Ni, Al, Sn and Co as the elements with a lower diffusion coefficient into Cu than that of Zn. Ni is desirable above all, for reasons including the control of covering thickness and alloy composition etc., in addition to the relatively easy coverability. With respect to Ni, it is particularly effective to cover the surface of the Cu or Cu alloy strip or heat-resisting copper strip as described above with Zn-Ni alloy having a Ni content of 6 to 18 wt. % in a thickness B, such that the Zn-Ni alloy thickness B divided by the total thickness A of the covered strip is in the range recited in equation (1):

$$B/A = 0.03 - 0.14 \quad (1)$$

Further, the heat diffusion treatment or, alternatively, the heat diffusion treatment and rolling processing are applied such that the Zn concentration of the diffused layer formed finally on the surface is from 10 to 42 wt. %.

DETAILED DESCRIPTION OF THE INVENTION

Figure 1:
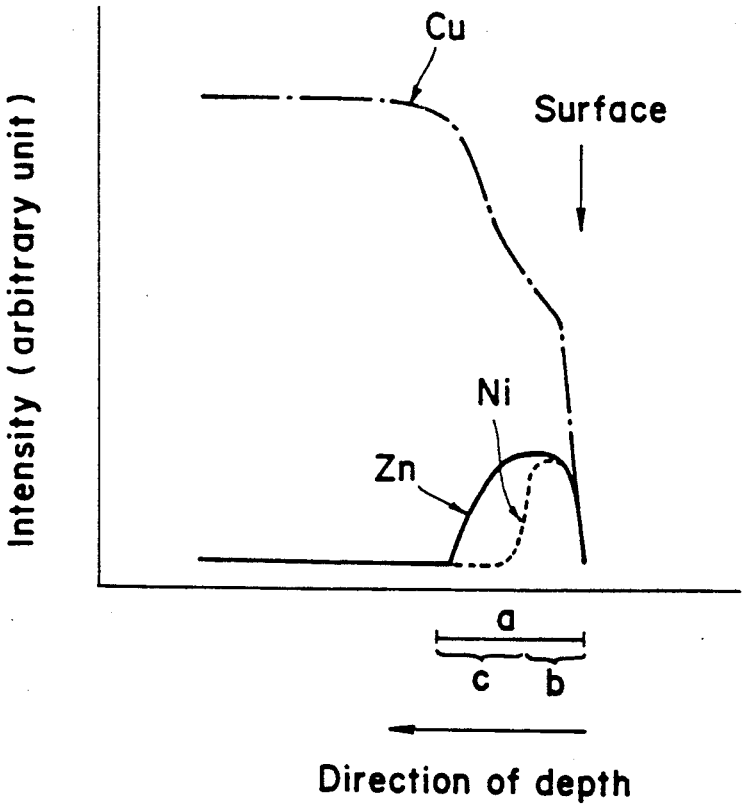
FIG. 1 is a chart showing one example of line analysis along the section of the diffused layer of fin material of the invention by the use of EPMA, wherein a indicates the total Zn-diffused layer, b indicates the Cu-Zn-Ni alloy-diffused layer, and c indicates the Cu-Zn alloy-diffused layer.
Figure 2:
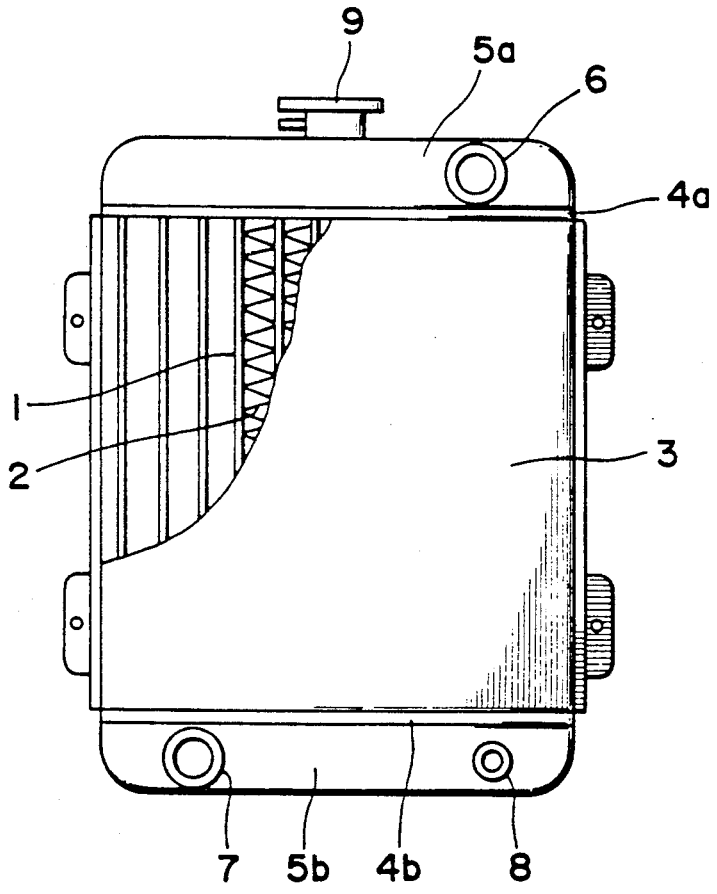
FIG. 2 shows one example of a radiator for cars, wherein 1 indicates a tube, 2 indicates a fin, 3 indicates a core, 4*a* and 4*b* indicate seat plates, and 5*a* and 5*b* indicate a tank.

According to the invention, after an alloy film comprising Zn and an element X with a lower diffusion coefficient into Cu than that of Zn exhibiting excellent corrosion resistance is formed on the surface of the Cu or Cu alloy, the diffusion treatment is performed under heat. Thus, by utilizing the difference in the diffusion velocity into Cu, a surface side diffused layer comprising Cu-Zn-X alloy containing the element X with a lower diffusion velocity into Cu than that of Zn is formed on the surface side, and further, an inner side diffused layer comprising Cu-Zn alloy is formed underneath the surface side diffused layer. By providing two diffused layers in this fashion, the dezincificative corrosion of surface is alleviated, and the decrease in electroconductivity arising from the addition of a sufficient amount of element X to suppress and effectively prevent dezincificative corrosion is kept to a low degree by retaining the element X on the surface side of the fin material, instead of allowing it to be distributed throughout both diffused layers. At the same time, the inside Cu or Cu alloy is protected through the sacrificial anode effect of Zn.

At least one member of the group consisting of Ni, Co, Sn and Al are used as elements X with a slower diffusion velocity into Cu than that of Zn. This is because the formation of a Zn alloy film containing not less than about 6 wt. % of iron group elements such as Ni and Co by a hot-dipping process needs a temperature of higher than about 700° C, which is impractical and very difficult industrially. However, the iron group elements and Zn can relatively easily form an alloy film by electroplating as an extraordinary eutectoid type alloy plating, in spite of the possibility that base Zn could deposit preferentially as a result of the potential difference between Zn and the iron group elements.

With respect to Sn and Al, in the case of Sn, the formation of a Zn-Sn alloy film is possible industrially by both electroplating and hot-dipping process. In the case of Al, the formation of a film plated with Zn-Al alloy is difficult by electroplating, but it is relatively easy by hot-dipping.

Moreover, when forming any alloy film, publicly known covering processes such as flame spray coating and PVD can be used, except for the processes aforementioned.

The following explanation is made with regard to restricting X to Ni.

As a process for covering with Zn-Ni alloy, the electroplating process is advantageous industrially. If the plating bath and the plating conditions are such that the Ni content in the film plated with Zn-Ni alloy is 6 to 18 wt. %, any electroplating bath such as, chloride bath, mixed bath of sulfate with chloride, sulfamine bath, etc. can be used.

The reason why the preferred Ni content is 6 to 18 wt. % is because a form mainly composed of δ phase exhibiting excellent corrosion resistance starts to appear at a Ni content of not less than 6 wt. %, and at approximately 10 wt. % or more, nearly complete conversion to a single δ phase occurs, thereby further improving the corrosion resistance. However, under 6 wt. %, the improvement in corrosion resistance is little or slight, if any, resulting in the merit of plating with Zn-Ni alloy being offset by the economical disadvantage of using expensive Ni. Moreover, the reason why the preferred Ni content is not more than 18 wt. % is because further improvement in the corrosion resistance cannot be expected by increasing the Ni content more than this level, and the increase in the amount of expensive Ni brings about the corresponding economical disadvantage. Even more preferably, a Ni content of 10 to 15 wt. % is desirable.

The diffusion treatment under heat after plating with Zn-Ni alloy strengthens the adhesion between the plated layer and the Cu or Cu alloy strip through the mutual diffusion between both. At the same time, by utilizing the difference in the diffusion velocity into Cu between Zn and Ni (Zn is faster than Ni), part of the Zn is replaced with Cu while retaining the form of Zn-Ni δ phase to make the surface side of diffused layer a highly corrosion-resisting Cu-Zn-Ni alloy layer and the underneath layer thereof a Cu-Zn alloy layer, thus forming two diffused layers, thereby both the sacrificial anode effect and high corrosion resistance are provided to the fin material.

The preferred Zn concentration in the surface side diffused layer is 10 to 42 wt. % due to the following reasons. In the case of diffused fin material plated with Zn-Ni alloy, the ratio of plating thickness on both sides to core material (covering index) is preferably 0.04 to 0.11 or so, considering the balance between the improvement in corrosion resistance and maintenance of the electroconductivity. Moreover, the plate thickness of the final fin material for heat-exchanger is generally 30 to 45 μm or so. If the diffusion treatment is given such that the amount of Zn in the surface side diffused layer becomes under less than 10 wt. %, excess diffusion results, and the decrease in electroconductivity becomes too large. Also, the corrosion resistance is poorer than that of a fin material with a Zn concentration of 10 wt. % in the surface of the diffused layer, if the plating thickness and the covering index are equal. In the case of diffusion treatment so as to exceed 42 wt. %, the diffusion is deficient and the solderability, rolling property, etc. become poor, though notably, there is no problem regarding the electroconductivity. Also, the corrosion resistance is poorer than that of one with a Zn concentration of 42 wt. % in the surface side diffused layer, if the plating thickness and the covering index are equal.

The reason why the B/A ratio was prescribed within the range recited in equation (1) described above is because, if B/A is under 0.03, the small decrease in the electroconductivity is good, but the improvement in corrosion resistance is minimal, resulting in the merit of plating with Zn-Ni alloy being offset by the economical disadvantage of using expensive Ni. Further, if B/A exceeds 0.14, sufficient improvement in corrosion resistance is observed, but a drastic decrease in the electroconductivity is brought about. This particularly results in an unsuitable fin material for automobile radiators. In addition, an increase in the weight of expensive Ni results in an undesirable economical disadvantage. Preferably, the value of B/A is from 0.045 to 0.10.

Furthermore, rolling processing improves the adhesion. Combined with heat diffusion, it enhances the accuracy of dimensions and gives the plated layer a processed texture, thereby improving the strength of fin material. Either the heat diffusion treatment or the rolling processing may be performed first to achieve the effects of the invention, but the rolling processing is desirably the final process.

The temperature for the diffusion treatment is preferably from 300° to 700° C. or so, though it depends on the treatment time.

TABLE 1

| | Plating bath No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| $NiSo_4.6H_2O$ (g/L) | 300 | — | 300 | 80 | 50 | 300 | 300 | 80 | 300 | 300 | 280 | — | — |
| $NiCl_2.6H_2O$ (g/L) | — | 180 | — | — | — | — | — | — | — | — | — | — | — |
| $ZnSO_4.7H_2O$ (g/L) | 80 | — | 250 | 240 | 250 | 20 | 80 | 220 | 80 | 200 | 80 | 250 | — |
| $ZnCl_2$ (g/L) | — | 80 | — | — | — | — | — | — | — | — | — | — | — |
| $Na_2SO_4$ (g/L) | 100 | — | 100 | 100 | 100 | 100 | 100 | 100 | 100 | 100 | 100 | 100 | — |
| $Al_2(SO_4)_3.14-18H_2O$ (g/L) | 30 | — | 30 | 30 | 30 | 30 | 30 | 30 | 30 | 30 | 30 | 30 | — |
| $NH_4Cl$ (g/L) | — | 230 | — | — | — | — | — | — | — | — | — | — | — |
| $H_3BO_3$ (g/L) | — | 20 | — | — | — | — | — | — | — | — | — | — | — |
| $Zn(CN)_2$ (g/L) | — | — | — | — | — | — | — | — | — | — | — | — | 14.5 |
| $Na_2Sn(OH)_6$ (g/L) | — | — | — | — | — | — | — | — | — | — | — | — | 67 |
| NaCN (g/L) | — | — | — | — | — | — | — | — | — | — | — | — | 30 |
| pH | 2.5 | 5.0 | 2.0 | 1.5 | 1.5 | 1.5 | 2.5 | 1.5 | 1.5 | 2.5 | 2.0 | 1.5 | — |
| Temperature (°C.) | 50 | 30 | 50 | 50 | 50 | 50 | 50 | 50 | 50 | 50 | 50 | 50 | 65 |
| Current density (A/dm$^2$) | 5 | 5 | 35 | 5 | 5 | 5 | 35 | 5 | 5 | 35 | 5 | 5 | 3 |

EXAMPLE 1

Employing the plating baths No. (1), (2), (3), (4), (5), (6) and (12) shown in Table 1, plating with Zn-Ni alloy in a thickness of 2.4 μm was performed on both sides of heat-resisting copper strips (electroconductivity: 95.5% IACS) having a thickness of 0.065 mm, which contain 0.02 wt. % of Mg. Then, these were submitted to heat diffusion treatment for 1 minute at 500° C., and further, to rolling processing to obtain fin materials with a thickness of 0.036 mm. The corrosion test was performed on the resulting fin materials, and the deterioration rate in the tensile strength was determined. The results, which are shown in Table 2, are compared with those of a fin material produced in such a way that, after plating with pure Zn in a thickness of 2.4 μm, the heat diffusion treatment was performed for 1 minute at 450° C., and then the thickness was made to be 0.036 mm by rolling processing.

For the corrosion test, after spraying with saline solution according to JIS Z2371 for 1 hour, the fin material was kept in a thermohygrostatic oven at a temperature of 70° C. and a humidity of 95% for 23 hours. This procedure was repeated 30 times.

TABLE 2

| Fin material | No. | Ni content in plated layer (wt. %) | Electroconductivity (% IACS) | Deterioration rate in strength (%) | External appearance after corrosion test | Plating bath |
|---|---|---|---|---|---|---|
| Fin material of the present invention | 1 | 13.7 | 82.4 | 31.7 | Dezincification slight | (1) |
| Fin material of the present invention | 2 | 10.1 | 83.0 | 32.4 | Dezincification slight | (2) |
| Fin material of the present invention | 3 | 11.7 | 82.4 | 32.1 | Dezincification slight | (3) |
| Fin material of the present invention | 4 | 6.3 | 83.6 | 42.1 | Dezincification medium | (4) |
| Comparative fin material | 5 | 5.0 | 83.8 | 51.2 | Dezincification heavy | (5) |
| Comparative fin material | 6 | 22.5 | 81.2 | 32.0 | Dezincification slight | (6) |
| Comparative | 7 | 0 | 85.2 | 55.9 | Overall | (12) |

TABLE 2-continued

| Fin material | No. | Ni content in plated layer (wt. %) | Electroconductivity (% IACS) | Deterioration rate in strength (%) | External appearance after corrosion test | Plating bath |
|---|---|---|---|---|---|---|
| fin material | | | | | dezincification | |

As is evident from Table 2, it is seen that for the comparative fin material No. 7, where the heat diffusion and rolling processing were performed after plating with pure Zn, a marked dezincification and a high deterioration in strength occurs. In contrast, fin materials Nos. 1 through 4 of the present invention show only a slight dezincification and a low deterioration in strength in all cases.

With the comparative fin material No. 5, the Ni content in plated film being less than 6.0 wt. %, the dezincification is remarkable and the deterioration in strength is high. Also, with the comparative fin material No 6, the Ni content being over the upper limit of 18 wt. %, no additional improvement in corrosion resistance is recognized, and the increased use of Ni leads to an increased cost, resulting in a significant economic disadvantage.

EXAMPLE 2

Employing the plating baths Nos. (1), (5), (6), (7) and (8) shown in Table 1, plating with Zn-Ni alloy was performed on both sides of heat resisting copper strips (electroconductivity: 95% IACS) having a thickness of 0.065 mm and containing 0.02 wt. % of Mg. Then, these plated strips were submitted to heat diffusion treatment at 300° to 600° C. to produce specimens having various Zn concentrations in the surface side diffused layer. These were further submitted to rolling processing to obtain fin materials with a thickness of 0.036 mm. Of these, the corrosion test was performed and the velocity of corrosion was determined. The results are shown in Table 3.

For the corrosion test, after spraying with saline solution according to JIS Z2371 for 1 hour, each of the fin materials was kept for 30 minutes in a thermostatic oven at a humidity of 30%, the each fin material was further kept in a thermohygrostatic oven at a temperature of 70° C. and a humidity of 95% for 22 5 hours. This procedure was repeated 30 times. Thereafter, only the corrosion products were dissolved and removed with a dilute solution of sulfuric acid, and the corrosion loss was determined from the weights before and after the corrosion test.

TABLE 3

| Fin material | No. | Ni content in plated film (wt. %) | Covering index (%) | Zn concentration in the surface side diffused layer (%) | Velocity of corrosion ($mg/dm^2/day$) | Electro-conductivity (%) | Soldera-bility | Rolling Prop-erty | External appearance after corrosion test | Plat-ing bath |
|---|---|---|---|---|---|---|---|---|---|---|
| Fin material of invention | 8 | 6.7 | 4.6 | 20.1 | 6.4 | 82.5 | 0 | 0 | Dezincification medium | (8) |
| Fin material of invention | 9 | 6.5 | 6.8 | 30.3 | 6.0 | 83.5 | 0 | 0 | Dezincification medium | (8) |
| Fin material of invention | 10 | 10.9 | 4.6 | 25.3 | 5.0 | 84.2 | 0 | 0 | Dezincification slight | (7) |
| Fin material of invention | 11 | 10.6 | 6.8 | 40.8 | 5.6 | 85.4 | 0 | 0 | Dezincification slight | (7) |
| Fin material of invention | 12 | 13.7 | 4.6 | 14.3 | 7.7 | 79.9 | 0 | 0 | Dezincification slight | (1) |
| Fin material of invention | 13 | 13.7 | 6.8 | 35.0 | 4.7 | 84.3 | 0 | 0 | Dezincification slight | (1) |
| Comparative fin material | 14 | 10.6 | 4.6 | 9.0 | 9.4 | 70.1 | 0 | 0 | Dezincification slight | (7) |
| Comparative fin material | 15 | 10.6 | 6.8 | 45.3 | 6.9 | 86.2 | X | X partial crack | Dezincification slight | (7) |
| Comparative fin material | 16 | 4.9 | 4.6 | 30.3 | 10.8 | 85.4 | 0 | 0 | Dezincification heavy | (5) |
| Comparative fin material | 17 | 22 | 4.6 | 30.0 | 5.9 | 84.7 | 0 | 0 | Dezincification slight | (6) |

As is evident from Table 3, dezincificative corrosion occurs in comparative fin material No. 16, even though the Ni content in the plated film is under the lower limit of 6 wt. %, despite the Zn concentration in the surface side diffused layer being within a range of 10 to 42 wt. %. Thus, it shows a large corrosion loss and exhibits poor corrosion resistance. In contrast, improved corrosion resistance can be seen in the fin materials No 8 through 13 of the present invention, wherein the Zn concentration in the surface of diffused layer being within a range of 10 to 42 wt. % and the Ni content in the plated film being within a range of 6 to 18 wt. %.

Moreover, in comparative fin material No. 14, wherein the Zn concentration in the surface side diffused layer is under the lower limit of 10 wt. % due to excess diffusion, despite the Ni content in the plated film being within a range of 6 to 18 wt. %, the decrease in the electroconductivity is high and the corrosion loss is also large, thus poor corrosion resistance is shown. Furthermore, with the comparative fin material No. 15, wherein the Zn concentration in the surface of diffused layer being over the upper limit of 42 wt. %, there arise problems with poor solderability and cracks forming during the rolling, and the like.

On the other hand, in the case of the comparative fin material No. 17, wherein the Ni content in the diffused layer being over 18 wt. %, no additional improvement in the corrosion resistance is recognized, and an increased use of Ni is linked to a cost increase, leading to an economical disadvantage.

EXAMPLE 3

Employing the plating baths No. (1), (2), (4), (5), (6), (9), (10) and (12) shown in Table 1, plating with Zn-Ni alloy was performed on both sides of heat-resisting copper strips (electroconductivity: 95.5% IACS) having a thickness of 0.065 mm and containing 0.02 wt. % of Mg, so as to make various ratios of B/A. Then, these were submitted to the heat diffusion treatment, and thereafter, to rolling processing to produce fin materials No. 18 through 28 with a thickness of 0.036 mm, which are shown in Table 4.

Of these, the electroconductivity was measured and, after a corrosion test similar to that in Example 1, the deterioration rate in the tensile strength was determined. These results were compared with the measurement results of a fin material with a thickness of 0.036 mm produced by comparative method No. 34; that is, in such a way that after plating with pure Zn in a thickness of 2.4 μm onto the surface of said heat-resisting copper strip, heat diffusion treatment, and thereafter rolling processing were performed, respectively. The comparative results are also shown in Table 4.

TABLE 4

| Fin material | No. | Ni content in plated layer (wt. %) | B/A | Conditions of heat diffusion treatment | Electro-conductivity (%) | Deterioration rate in strength (%) | External appearance after corrosion test | Plating bath No. used |
|---|---|---|---|---|---|---|---|---|
| Fin material of invention | 18 | 13.7 | 0.11 | 500°C. × 10 min | 82.0 | 30.2 | Dezincification slight | 9 |
| Fin material of invention | 19 | 12.0 | 0.06 | 500°C. × 5 min | 83.5 | 33.6 | Dezincification slight | 10 |
| Fin material of invention | 20 | 13.7 | 0.04 | 500°C. × 1 min | 85.1 | 43.2 | Dezincification medium | 9 |
| Fin material of invention | 21 | 12.0 | 0.04 | 500°C. × 1 min | 84.8 | 42.7 | Dezincification medium | 10 |
| Fin material of invention | 22 | 13.7 | 0.04 | 500°C. × 1 min | 84.8 | 42.1 | Dezincification medium | 1 |
| Fin material of invention | 23 | 12.0 | 0.04 | 500°C. × 1 min | 85.1 | 42.5 | Dezincification medium | 10 |
| Fin material of invention | 24 | 6.5 | 0.06 | 500°C. × 5 min | 83.6 | 41.3 | Dezincification medium | 4 |
| Fin material of invention | 25 | 10.3 | 0.07 | 500°C. × 5 min | 83.2 | 31.2 | Dezincification slight | 2 |
| Fin material of invention | 26 | 10.3 | 0.08 | 500°C. × 5 min | 82.9 | 30.4 | Dezincification slight | 2 |
| Fin material of invention | 27 | 13.7 | 0.10 | 550°C. × 10 min | 82.4 | 30.0 | Dezincification slight | 1 |
| Fin material of invention | 28 | 6.5 | 0.12 | 550°C. × 10 min | 81.1 | 36.1 | Dezincification slight | 4 |
| Comparative fin material | 29 | 12.0 | 0.17 | 550°C. × 10 min | 75.2 | 30.0 | Dezincification slight | 10 |
| Comparative fin material | 30 | 13.7 | 0.02 | 500°C. × 1 min | 86.4 | 57.1 | Dezincification heavy | 9 |
| Comparative fin material | 31 | 4.9 | 0.06 | 500°C. × 5 min | 84.9 | 51.8 | Dezincification heavy | 5 |
| Comparative fin material | 32 | 22.1 | 0.06 | 500°C. × 5 min | 82.0 | 32.6 | Dezincification slight | 6 |
| Comparative fin material | 33 | 13.7 | 0.02 | 500°C. × 1 min | 86.4 | 56.2 | Dezincification slight | 1 |
| Comparative fin material | 34 | 0 | — | 450°C. × 1 min | 85.2 | 55.6 | Overall dezincification | |

As is evident from Table 4, the comparative fin material No. 34, the diffusion treatment under heat and the rolling processing being added thereto after plating with pure Zn, exhibits a marked dezincification and a high deterioration in strength. It can be seen however that, with the fin materials No. 18 through 28 of the invention, the dezincification is slight and the deterioration in strength is low.

On the contrary, with the comparative fin material No. 31, the Ni content being under 6 wt. % despite the B/A ratio being within a prescribed range, the deterioration in strength is severe, and, on the other hand, with the comparative fin material No. 32, the Ni content being over 18 wt. %, not only is there no additional improvement in corrosion resistance, but also an increased Ni content leads to a disadvantage in cost.

Moreover, the comparative fin materials No. 30 and No. 33, the B/A ratio being under 0.03 despite the Ni content being within a prescribed range, show a marked deterioration in strength.

In the case of comparative fin material No. 29, said ratio being over 0.14, additional improvement in the corrosion resistance is not seen. Further, the decrease in the electroconductivity becomes high, and the increased weight is connected with increased cost leading to the economical disadvantage.

EXAMPLE 4

Copper was molten using a high-frequency melting furnace while covering the surface of the melt with charcoal. By adding predetermined elements to this, homogeneous alloy melts were prepared to be cast into ingots with compositions shown in Table 5. After the surface was shaven by 2.5 mm, these ingots were heated for 1 hour at 850° C. and rolled to a thickness of 10 mm by hot rolling. The resulting strips were subjected to cold rolling, and the annealing was repeated to obtain prime strips with a thickness of 0.035 mm.

Next, the prime strips were plated as shown in Table 5, employing the plating baths No. (11) and (13) described in Table 1. The plating with Zn-Ni alloy or Zn-Sn alloy, the compositions of which are shown in Table 5, was performed such that a thickness of 1.2 μm was achieved, and then heat diffusion treatment was performed for 5 minutes at 350° C. Of these fin materials No. 35 through No. 44, the hardness against heat and the electroconductivity were determined. Moreover, the corrosion test of Example 1 was performed to measure the deterioration rate in the tensile strength and to evaluate the degree of dezincification by the observation of external appearance.

These results are shown in Table 5 together with the measurement results as above of fin materials No. 45 through No. 47, which were produced in such a way that, after plating the prime strips aforementioned with pure Zn in a thickness of 1.2 μm in plating bath No. (12), the comparative plated prime strips were submitted to heat diffusion treatment for 5 minutes at 350° C.

are out of the prescribed range, have either poor heat resistance or poor electroconductivity.

Moreover, as is evident from FIG. 1, it can be observed that the Zn-diffused layer (a) formed in the surface layer of the fin material of the invention plated with Zn-Ni alloy consists of two layers: the first being Cu-Zn-Ni alloy-diffused layer (b) on the surface side, and the second being Cu-Zn alloy-diffused layer (c) on the inner side thereof.

EXAMPLE 5

Ingots having same compositions as those of ingots

TABLE 5

| | | Characteristics of prime strip before plating | | | Characteristics of fin material after diffusion treatment under heat | | | | | |
|---|---|---|---|---|---|---|---|---|---|---|
| | | Chemical composition (%) | | Electrocon- | | Hardness against | Electrocon- | Deterior- ation in | External appearance | Plating bath |
| Fin Material | No. | Cu | Additional element(s) | ductivity (% IACS) | Composition of film | heat (Hv) | ductivity (% IACS) | strength (%) | after corrosion test | No. applied |
| Present Invention | 35 | Balance | Zr 0.03, P 0.02 | 93 | Zn - 11.8% Ni | 112 | 83.6 | 31.4 | Dezincification slight | 11 |
| Present Invention | 36 | " | Cr 0.02, Sn 0.02 | 92 | Zn - 49.8% Sn | 104 | 82.0 | 37.6 | Dezincification slight | 13 |
| Present Invention | 37 | " | Mg 0.03 | 97 | Zn - 12.6% Ni | 107 | 86.0 | 32.5 | Dezincification slight | 11 |
| Present Invention | 38 | " | Ag 0.1 | 98 | Zn - 50.4% Sn | 118 | 87.6 | 38.3 | Dezincification slight | 13 |
| Present Invention | 39 | " | Pb 0.03, Sn 0.01 | 94 | Zn - 11.9% Ni | 105 | 83.9 | 33.0 | Dezincification slight | 11 |
| Present Invention | 40 | " | P 0.01, Mg 0.02 Zn 0.01 | 91 | Zn - 12.2% Ni | 117 | 80.0 | 31.9 | Dezincification slight | 11 |
| Present Invention | 41 | " | Ni 0.01, P 0.02 | 93 | Zn - 51.0% Sn | 110 | 81.7 | 37.4 | Dezincification slight | 13 |
| Comparative fin material | 42 | " | Cr 0.005, Sn 0.003 | 98 | Zn - 12.3% Ni | 71 | 86.4 | 33.1 | Dezincification slight | 11 |
| Comparative fin material | 43 | " | Zr 0.005 | 98 | Zn - 11.9% Ni | 80 | 87.0 | 32.0 | Dezincification slight | 11 |
| Comparative fin material | 44 | " | Cr 0.10, P 0.02, Sn 0.05 | 79 | Zn - 12.4% Ni | 120 | 68.7 | 31.8 | Dezincification slight | 11 |
| Comparative fin material | 45 | " | Mg 0.03, Zn 0.01 | 95 | 100% Zn | 109 | 86.3 | 56.1 | overall de-zincification | 12 |
| Comparative fin material | 46 | " | Mg 0.03 | 97 | " | 107 | 86.2 | 57.6 | overall de-zincification | 12 |
| Comparative fin material | 47 | " | Ag 0.1 | 98 | " | 118 | 87.4 | 56.2 | overall de-zincification | 12 |

Results obtained by conducting line analysis along the section of the diffused layers by the use of EPMA is shown in FIG. 1 for one example of the fin material of the present invention, wherein plating with Zn-Ni alloy and heat diffusion treatment is being performed for 30 minutes at 350° C.

The hardness against heat in Table 5 shows the results obtained through the measurement of Vickers hardness (hv) after heat diffusion treatment for 5 minutes at 350° C.

As is evident from Table 5, it is observed that for the comparative fin materials No. 45 through 47 plated with pure Zn, the dezincification in the surface is remarkable and the deterioration in strength due to corrosion is conspicuous, whereas the fin materials No. 35 through 41 of the present invention exhibit slight dezincification after the corrosion test, low deterioration in strength, and improved corrosion resistance.

Further, it can be seen that the fin materials No. 35 through 41 of the present invention have both excellent heat resistance and excellent electroconductivity together with the improved corrosion resistance, but the comparative examples No. 42 through 44, wherein the chemical ingredients of prime strips as base materials cast in Example 4, the compositions of which are shown in Table 6, were processed similarly to Example 4 to obtain prime strips with a thickness of 0.065 mm.

Plated films of either Zn-Ni alloy or Zn-Sn alloy in a thickness of 2.4 μm per side, the compositions of which are shown in Table 6, were formed on both sides of these prime strips employing either plating bath No. (11) or No. (13) described in Table 1. Alternatively, films with Zn - 10% Al alloy in a thickness of 4 μm per side were formed by a hot dipping method. Then, the strips were submitted to heat diffusion treatment for 1 minute at 500° C., and thereafter, to rolling processing to produce fin materials No. 48 through 62 having a thickness of 0.036 mm.

Of these, the hardness against heat and the electroconductivity were determined, and the same tests as in Example 4 were conducted to measure the deterioration rate in the tensile strength and to evaluate the degree of dezincification by observing the external appearance. These results are shown in Table 6 together with the measurement results of comparative fin materials No. 60 through 62 having a thickness of 0.036 mm, after the corrosion test. The comparative fin materials were produced in such a way that, after plating the primer strips with pure Zn in a thickness of 2.4 μm per side in the plating bath No. 12 aforementioned, these were submitted to heat diffusion treatment for 1 minute at 450° C., and thereafter, to rolling processing.

TABLE 6

| Fin Material | No. | Characteristics of prime strip before plating: Chemical composition (%) Cu | Additional element(s) | Electroconductivity (% IACS) | Characteristics of fin material after diffusion treatment under heat: Composition of film | Hardness against heat (Hv) | Electroconductivity (% IACS) | Deterioration in strength (%) | External appearance after corrosion test | Plating bath No. applied |
|---|---|---|---|---|---|---|---|---|---|---|
| Present Invention | 48 | Balance | Zr 0.03, P 0.02 | 93 | Zn - 11.6% Ni | 112 | 82.0 | 30.7 | Dezincification slight | 11 |
| Present Invention | 49 | " | Cr 0.02, Sn 0.02 | 92 | Zn - 50.0% Sn | 104 | 80.3 | 36.8 | Dezincification slight | 13 |
| Present Invention | 50 | " | Mg 0.03 | 97 | Zn - 12.3% Ni | 107 | 83.9 | 33.2 | Dezincification slight | 11 |
| Present Invention | 51 | " | " | 97 | Zn - 10.3% Al | 107 | 82.8 | 29.5 | Dezincification slight | Hot dipping |
| Present Invention | 52 | " | Ag 0.1 | 98 | Zn - 49.7% Sn | 118 | 84.9 | 37.0 | Dezincification slight | 13 |
| Present Invention | 53 | " | " | 98 | Zn - 10.2% Al | 118 | 82.3 | 30.0 | Dezincification slight | Hot dipping |
| Present Invention | 54 | " | Pb 0.03, Sn 0.01 | 94 | Zn - 12.0% Ni | 105 | 81.9 | 32.1 | Dezincification slight | 11 |
| Present Invention | 55 | " | P 0.01, Mg 0.02, Zn 0.01 | 91 | Zn - 11.8% Ni | 117 | 78.0 | 32.3 | Dezincification slight | 11 |
| Present Invention | 56 | " | Ni 0.01, P 0.02 | 93 | Zn - 50.3% Sn | 110 | 80.3 | 37.1 | Dezincification slight | 13 |
| Comparative fin material | 57 | " | Cr 0.005, Sn 0.003 | 98 | Zn - 12.4% Ni | 71 | 84.1 | 33.3 | Dezincification slight | 11 |
| Comparative fin material | 58 | " | Zr 0.005 | 98 | Zn - 12.5% Ni | 80 | 84.6 | 31.9 | Dezincification slight | 11 |
| Comparative fin material | 59 | " | Cr 0.10, P 0.02, Sn 0.05 | 79 | Zn - 12.0% Ni | 120 | 66.2 | 32.4 | Dezincification slight | 11 |
| Comparative fin material | 60 | " | Mg 0.03, Zn 0.01 | 95 | 100% Zn | 109 | 85.9 | 58.0 | Overall dezincification | 12 |
| Comparative fin material | 61 | " | Mg 0.03 | 97 | " | 107 | 85.9 | 56.3 | Overall Dezincification | 12 |
| Comparative fin material | 62 | " | Ag 0.1 | 98 | " | 118 | 86.3 | 55.9 | Overall Dezincification | 12 |

As is evident from Table 6, it can be seen that the fin materials No. 48 through 56 of the present invention exhibit both excellent heat resistance and excellent electroconductivity together with the corrosion resistance. However, with the comparative fin materials No. 57 through 59, wherein the chemical compositions of prime strips as base materials are out of the prescribed range, either the heat resistance or the electroconductivity is poor, and, with all of the comparative fin materials No. 60 through 62, wherein plating is performed with 100% Zn, the corrosion resistance is decreased.

EXAMPLE 6

Using plating baths No. 11 and 13 described in Table 1 and shown in Table 7, both sides of heat-resisting copper strips (electroconductivity: 95.5%) having a thickness of 0.035 mm and containing 0.02 wt. % of Mg were plated with Zn-Ni alloy or Zn-Sn alloy in a thickness of 1.2 μm. Then, the resulting plated strips were submitted to heat diffusion treatment for 30 minutes at 350° C. to produce the fin materials of the present invention.

Of these, the corrosion test of Example 1 was performed, and the deterioration rate in the tensile strength was measured. The results were compared with those of a comparative fin material produced in such a way that, after plating with pure Zn in a thickness of 1.2 μm using the plating bath No. 12 described in Table 1, this Zn-plated strip submitted to heat diffusion treatment for 30 minutes at 350° C., the results of which are shown in Table 7.

TABLE 7

| Fin material | No. | Composition of plated film | Characteristics of fin material after heat diffusion treatment: Electroconductivity (% IACS) | Deterioration in strength (%) | External appearance after corrosion test | Plating bath No. applied |
|---|---|---|---|---|---|---|
| Present Invention | 63 | Zn - 12.1% Ni | 83.4 | 31.2 | Dezincification slight | 11 |
| Present Invention | 64 | Zn - 51.2% Ni | 83.1 | 37.4 | Dezincification slight | 13 |
| Comparative fin material | 65 | 100% Zn | 85.8 | 56.1 | Overall dezincification | 12 |

As is evident from Table 7, the comparative fin material No. 65 plated with pure Zn exhibits a marked deterioration in strength due to corrosion, whereas the fin materials No. 63 and 64 of the present invention show a low deterioration in strength and an improved corrosion resistance.

EXAMPLE 7

Next, employing the plating baths No. (11) and (13) aforementioned, both sides of heat-resisting copper strips (electroconductivity: 95.5%) having a thickness of 0.065 mm and containing 0.02 wt. % of Mg were plated with Zn-Ni alloy or Zn-Sn alloy in a thickness of 2.4 μm. Then, these plated strips were submitted to heat diffusion treatment for 1 minute at 500° C., then to rolling processing to obtain the fin materials No. 66 and 67 of the present invention, having a thickness of 0.036 mm.

Moreover, a film with Zn-10% Al alloy in a thickness of 4 μm was formed on an identical heat-resisting copper strip with a thickness of 0.065 mm by the hot dipping method, and then this strip was submitted to heat diffusion treatment for 1 minute at 500° C. and to rolling processing to obtain the fin material No. 68 of the present invention, having a thickness of 0.036 mm.

Of these, the corrosion test was performed and the deterioration rate in the tensile strength was measured. The results were compared with those of comparative fin material No. 69 having a thickness of 0.036 mm, produced in such a way that, after plating with pure Zn in a thickness of 2.4 μm using the plating bath No. 12 described in Table 1, the Zn-plated strip was submitted to heat diffusion treatment for 1 minute at 450° C., and thereafter, to rolling processing, the results of which are shown in Table 8.

TABLE 8

| Fin material | No. | Composition of film | Characteristics of fin material after diffusion treatment under heat: Electro-conductivity (% IACS) | Deterioration rate in strength after corrosion test (%) | External appearance after corrosion test | Plating bath No. applied |
|---|---|---|---|---|---|---|
| Fin material of invention | 66 | Zn - 11.8% Ni | 82.3 | 32.3 | Dezincification slight | 11 |
| Fin material of invention | 67 | Zn - 50.9% Sn | 81.7 | 38.4 | Dezincification slight | 13 |
| Fin material of invention | 68 | Zn - 10.1% Al | 81.4 | 37.6 | Dezincification slight | Hot dipping |
| Comparative fin material | 69 | 100% Zn | 85.1 | 55.9 | Overall dezincification | 12 |

As is evident from Table 8, with the comparative fin material No. 69, obtained by plating with pure Zn and then submitting to heat diffusion and rolling processing, the dezincification is remarkable and the deterioration in strength is high. On the other hand, in the fin materials No. 66 through 68 of the invention, the dezincification is slight and the deterioration in strength is low.

As described, in accordance with the present invention, the corrosion resistance of copper fin materials for heat-exchangers is improved effectively, and simultaneously the thermal conductivity is effectively maintained. Consequently, the invention enables industrially conspicuous effects, such as improved use life as a radiating fin, and makes possible the thinning and lightening in weight of a heat-exchanger fin material. Thus, the fin materials can also be utilized for electronic components used in corrosive environments, and others.

We claim:

1. A method of producing a copper fin material for heat-exchanger comprising the steps of:

preparing a strip of Cu or a Cu alloy, forming an alloy film comprising Zn and at least one element having a lower diffusion coefficient into Cu than that of Zn on a surface of said Cu or Cu alloy strip, and heating said alloy film and said Cu or Cu alloy strip, sufficiently to form an inner side diffused layer comprising Cu and Zn and a surface side diffused layer comprising Cu, Zn and at least one element with a lower diffusion coefficient into Cu than that of Zn.

2. The method of claim 1, wherein said element with a lower diffusion coefficient into Cu than that of Zn is selected from the group consisting of Ni, Al, Sn and Co.

3. The method of claim 1, wherein said element having a lower diffusion coefficient into Cu than that of Zn is Ni, said alloy film is Zn-Ni alloy having a Ni content of from 6 to 18 wt. %, and said alloy film is formed by electroplating.

4. The method of claim 1, wherein said heating is sufficient to produce a concentration of Zn in said surface side diffused layer of from 10 to 42 wt. %.

5. The method of claim 3, wherein said Zn-Ni alloy has a thickness B, said Cu or Cu alloy strip has a thickness A, and said forming step is conducted such that the ratio of said thickness B of said Zn-Ni alloy to said thickness A of said Cu or Cu alloy strip is according to the formula:

$$0.03 \leqq B/A \leqq 0.14.$$

6. The method of claim 1, wherein said Cu alloy strip comprises Cu and at least one element selected from the group consisting of Mg, Zn, Sn, Cd, Ag, Ni, P, Zr, Cr, Pb and Al in an amount of from 0.01 to 0.13 wt. %.

7. The method of claim 6, wherein said element with a lower diffusion coefficient into Cu than that of Zn is selected from the group consisting of Ni, Al, Sn and Co.

8. The method of claim 1, wherein said reducing is conducted by rolling.

* * * * *